US007484978B1

(12) United States Patent
Gao

(10) Patent No.: US 7,484,978 B1
(45) Date of Patent: Feb. 3, 2009

(54) CARD EDGE CONNECTOR

(75) Inventor: Tian Hui Gao, Nan County, Hunan Province (CN)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/078,970

(22) Filed: Apr. 9, 2008

(30) Foreign Application Priority Data

Jul. 10, 2007 (CN) ..... 2007 2 0053911 U

(51) Int. Cl.
*H01R 13/62* (2006.01)

(52) U.S. Cl. ..... 439/160; 439/157

(58) Field of Classification Search ..... 439/160, 439/157, 153, 328, 327, 326
See application file for complete search history.

(56) References Cited

U.S. PATENT DOCUMENTS 6,074,231 A * 6/2000 Ju ..... 439/327
6,159,031 A * 12/2000 Llapitan et al. ..... 439/326
6,319,027 B1 * 11/2001 Pickles et al. ..... 439/157
6,702,598 B1 * 3/2004 Lo ..... 439/157
6,981,886 B1 * 1/2006 Co et al. ..... 439/160
7,029,307 B1 * 4/2006 Ling et al. ..... 439/327
7,083,448 B2 * 8/2006 Tanigawa ..... 439/160
7,371,097 B1 * 5/2008 Pennypacker et al. ..... 439/327

FOREIGN PATENT DOCUMENTS

CN ZL00217090.6 3/2001

* cited by examiner

*Primary Examiner*—Neil Abrams
*Assistant Examiner*—Phuong Nguyen
(74) *Attorney, Agent, or Firm*—Rosenberg, Klein & Lee

(57) ABSTRACT

A card edge connector for electrically connecting an electronic card with an upper notch and a lower notch in its lateral edges to a circuit board includes an elongated insulating body, conducting terminals received in the insulating body and an ejecting mechanism pivotingly combined with at least one end of the insulating body. The ejecting mechanism includes a main portion, an ejecting portion and an operating portion. The ejecting portion and the operating portion respectively extend from two ends of the main portion. The ejecting mechanism further has a fastening portion for fastening the lower notch. The operating portion has an upper end surface through which an opening extends. The fastening portion is located under the opening. Using on the above structure, the electronic card can be easily secured in the insulating body. The present invention has a reduced height and lower cost, which is suitable for mass production.

6 Claims, 3 Drawing Sheets

CARD EDGE CONNECTOR

BACKGROUND OF THE INVENTION

1. Field of the Invention

The present invention relates to a card edge connector, and especially to a card edge connector with an ejecting mechanism.

2. Description of Related Art

Generally, conventional connectors for Dual In-line Memory Modules (DIMM) are card edge connectors with ejecting mechanisms on its two sides. Each ejecting mechanism is pivotingly mounted in an insulating body of the card edge connector, and has a fastener on an upper end thereof for engaging with a notch in a lateral edge of a memory card which is inserted into the insulating body to retain the memory card in the card edge connector. However, conventional memory cards always have upper notches and lower notches arranged in their lateral edges, and the fasteners of the ejecting mechanisms always fasten the upper notches and don't engage with the lower notches. For example, a card edge electrical connector disclosed in Chinese Patent No. 00217090 includes an insulating body and an ejecting mechanism pivotingly mounted in the insulating body. A fastener of the ejecting mechanism fastens an upper notch in a sub-circuit board. A recessed portion in a side wall of the insulating body and a lower notch in the sub-circuit board align with each other in a side direction of the insulating body. Though the connector can steadily retain the sub-circuit board (or called memory card) in the insulating body, because the fastener of the ejecting mechanism fastens the upper notch and don't fasten the lower notch, it is necessary that not only the side wall of the insulating body but also the ejecting mechanism are designed to be very high to engage with the upper notch of the sub-circuit board. The above conventional connectors have high cost and are difficult to assemble. Hence, there is a need for a new card edge connector to overcome the above shortcomings.

SUMMARY OF THE INVENTION

The object of the present invention is to provide a card edge connector which can fasten a lower notch of an electronic card.

To achieve the above-mentioned object, a card edge connector for electrically connecting an electronic card with an upper notch and a lower notch in a lateral edge thereof to a circuit board in accordance with the present invention is provided. The card edge connector includes an elongated insulating body, conducting terminals received in the insulating body and an ejecting mechanism pivotingly combined with at least one end of the insulating body. The ejecting mechanism includes a main portion, an ejecting portion and an operating portion. The ejecting portion and an operating portion respectively extend from two ends of the main portion. The ejecting mechanism further has a fastening portion for fastening the lower notch of the electronic card. The operating portion has an upper end surface through which an opening extends. The fastening portion is located under the opening.

The present invention is advantageous that since the fastening portion of the ejecting mechanism can directly fasten the lower notch of the electronic card and the operating portion of the ejecting mechanism has the opening which can engage with the two sides of the electronic card, the electronic card can be easily retained in the insulating body. The present invention not only can reduce the height of the insulating body and the ejecting mechanism, but also can save cost, which is suitable for mass production.

DETAILED DESCRIPTION OF THE PREFERRED EMBODIMENTS

Figure 2:
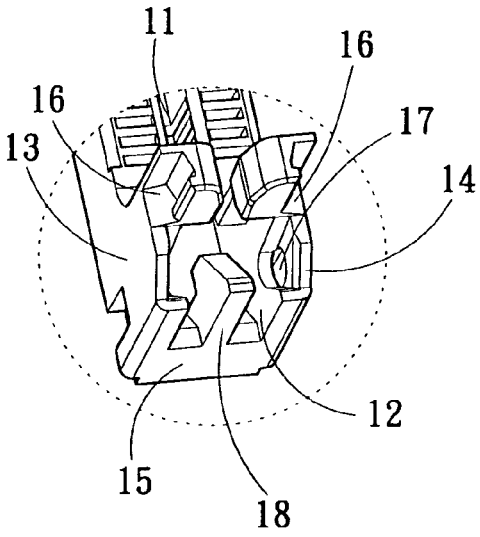
FIG. 2 is a partially enlarged view of part A in FIG. 1 showing an insulating body of the card edge connector.
Figure 1:
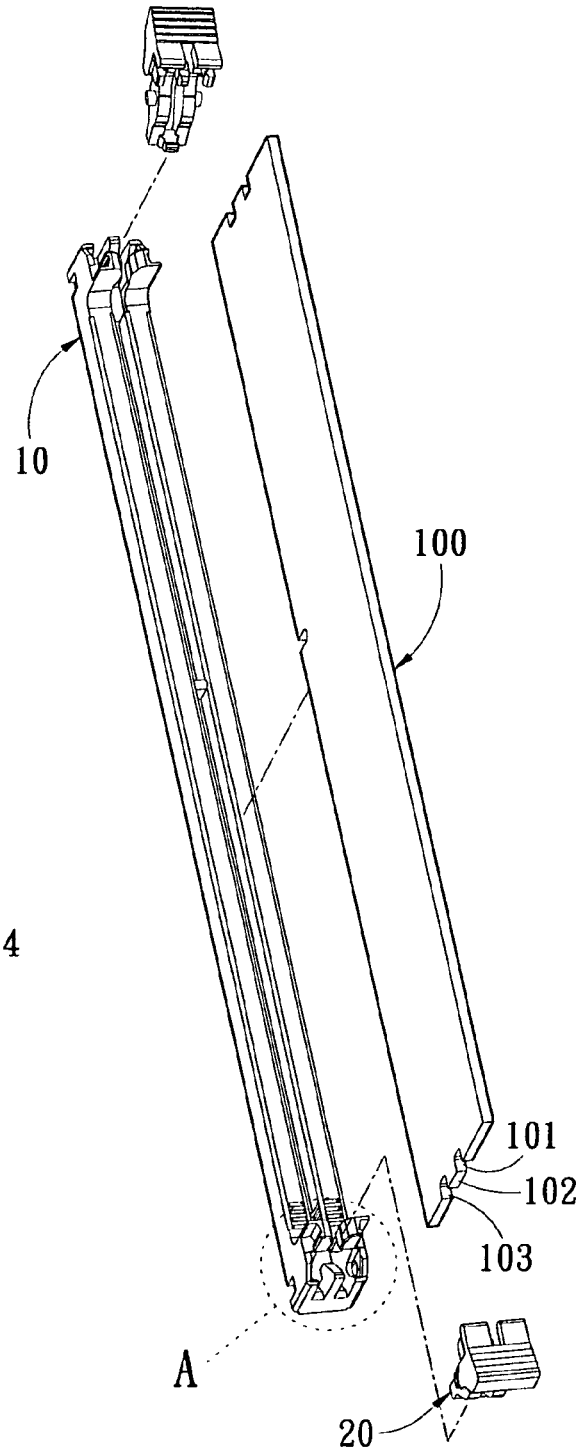
FIG. 1 is an exploded perspective view of an electronic card and a card edge connector according to the present invention.
Figure 3:
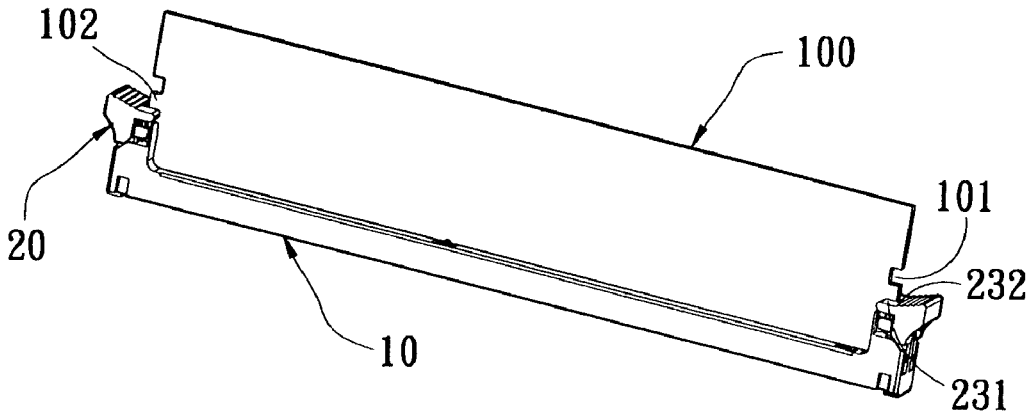
FIG. 3 is an assembled perspective view of the electronic card and the card edge connector in FIG. 1.

Please refer to FIGS. 1-3, a card edge connector according to the present invention is provided for electrically connecting an electronic card 100 to a circuit board (not shown). The electronic card 100 has an upper notch 101 and a lower notch 103 arranged in each lateral edge thereof from up to down. A wall 102 protrudes between the upper notch 101 and the lower notch 103 on each lateral edge of the electronic card 100. The card edge connector engages with the lower notch 103 and two sides of the wall 102 so as to retain the electronic card 100 therein.

The card edge connector includes an elongated insulating body 10, a plurality of conducting terminals (not shown) and at least one ejecting mechanism 20. The insulating body 10 has a central slot 11 (as shown in FIG. 2) formed therein, in which the electronic card 100 may be inserted, and receiving spaces 12 respectively formed in two ends thereof for receiving the ejecting mechanisms 20. Each receiving space 12 has two opposite side walls 13, 14 and an end wall 15. A recessed portion 16 extends upwardly from each of the side walls 13, 14. Each side wall 13, 14 further forms with a shaft hole 17 which communicates with the receiving space 12. A protruding portion 18 extends upwardly from the end wall 15 into the receiving space 12.

Figure 5:
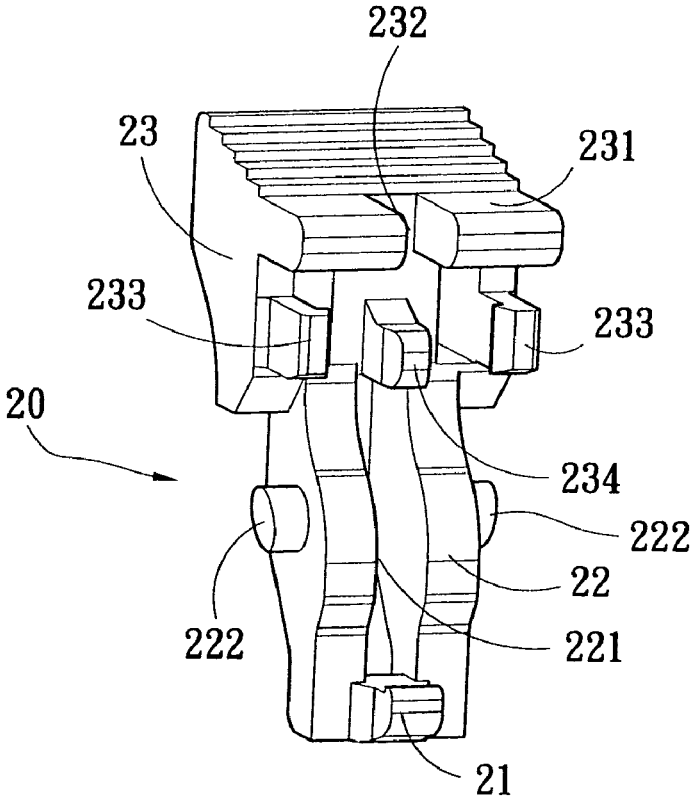
FIG. 5 is a perspective view of an ejecting mechanism of the card edge connector in FIG. 1.
Figure 4:
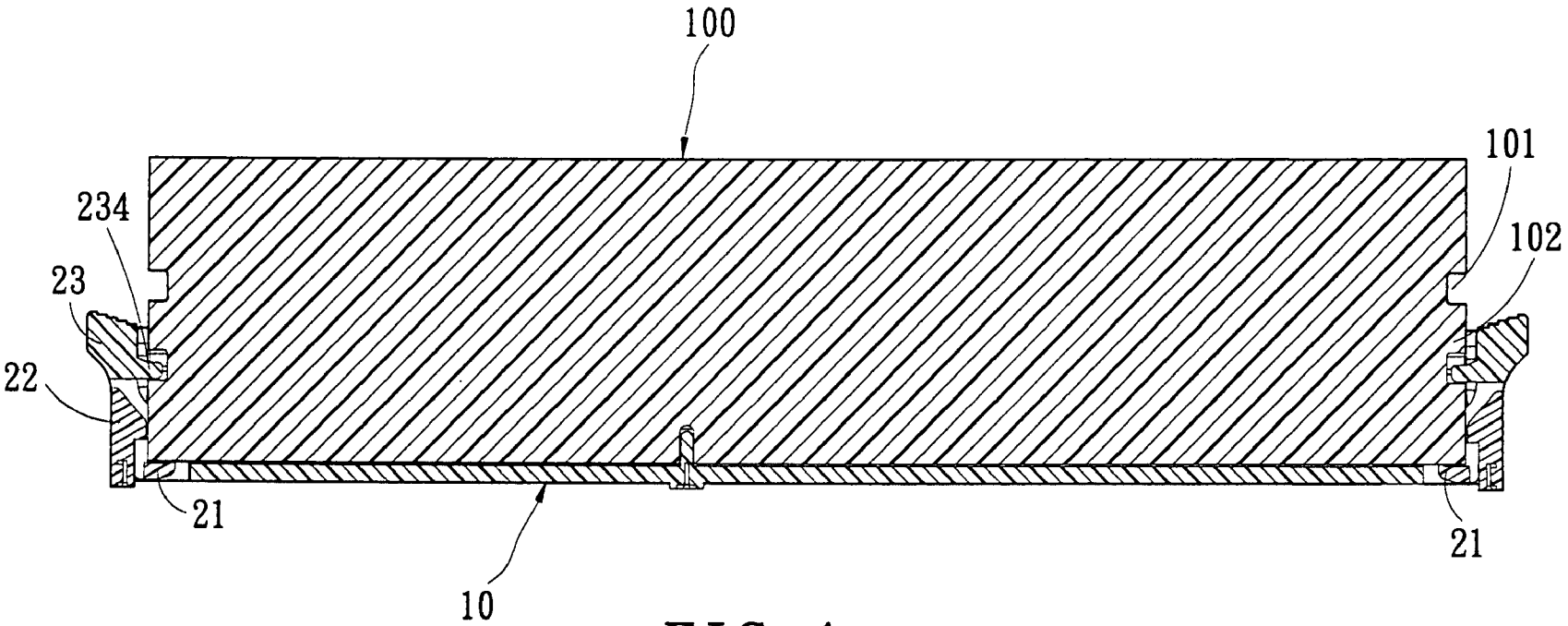
FIG. 4 is a cross-sectional view of the electronic card and the card edge connector in FIG. 3.

As shown in FIG. 5, and please refer to FIG. 1, FIG. 2 and FIG. 4 simultaneously, the ejecting mechanism 20 is pivotingly combined with at least one end of the insulating body 10. The ejecting mechanism 20 includes a main portion 22, an ejecting portion 21 and an operating portion 23. The ejecting portion 21 and the operating portion 23 respectively extend from two opposite ends of the main portion 22. The main portion 22 has a groove 221 formed in a middle thereof, in which the protruding portion 18 of the insulating body 10 is received, and shafts 222 extending outwardly from two sides thereof, which engage with the shaft holes 17 of the insulating body 10. Through the engagement of the two shafts 222 and the two shaft holes 17, the ejecting mechanism 20 may be pivotingly combined in the receiving space 12 of the insulating body 10.

The operating portion 23 is used for fastening the electronic card 100. The operating portion 23 has an upper end surface 231. An opening 232 extends through the upper end surface 231. The opening 232 may engage with two sides of the wall 102 disposed between the upper notch 101 and the lower notch 103 of the electronic card 100.

A first position arm 233 and a second positioning arm 233 extend from two sides of the operating portion 23 respectively. The first and the second positioning arms 233 are secured on the insulating body 10 and are respectively received in the two recessed portions 16 of the insulating body 10 to fix the ejecting mechanism 20 on the insulating body 10. The operating portion 23 further has a fastening portion 234 located between the first and the second positioning arms 233 under the opening 232. The fastening portion 234 may fasten the lower notch 103 of the electronic card 100.

In assembly, firstly, assemble the ejecting mechanism 20 on the insulating body 10, and insert the electronic card 100 into the central slot 11 of the insulating body 10, and then turn the ejecting mechanism 20 so that the fastening portion 234 of the ejecting mechanism 20 fastens the lower notch 103 and the opening 232 of the ejecting mechanism 20 engages with the two sides of the wall 102 disposed between the upper notch 101 and the lower notch 103 of the electronic card 100. Thereby the electronic card 100 can be retained in the insulating body 10. To remove the electronic card 100, the ejecting mechanism 20 is pulled outwardly, and the ejecting portion 21 will eject the bottom edge of the electronic card 100, such that the electronic card 100 will jump out of the insulating body 10.

What is claimed is:

1. A card edge connector for electrically connecting an electronic card with an upper notch and an lower notch in its lateral edges to a circuit board, comprising:

an elongated insulating body;

a plurality of conducting terminals respectively received in the insulating body; and an ejecting mechanism pivotingly combined with at least one end of the insulating body, comprising:

a main portion;

an ejecting portion extending from one end of the main portion;

an operating portion extending from the other end of the main portion, and having an upper end surface through which an opening extends; and a fastening portion located under the opening, and fastening the lower notch of the electronic card.

2. The card edge connector as claimed in claim 1, wherein the fastening portion extends from the operating portion.

3. The card edge connector as claimed in claim 1, wherein the opening engages with two sides of a wall disposed between the upper notch and the lower notch of the electronic card.

4. The card edge connector as claimed in claim 1, wherein the operating portion further has a first positioning arm and a second positioning arm extending therefrom, which are secured on the insulating body.

5. The card edge connector as claimed in claim 4, wherein the fastening portion is located between the first positioning arm and the second positioning arm.

6. The card edge connector as claimed in claim 4, wherein the insulating portion has recessed portions engaging with the first position arm and the second positioning arm, respectively.

* * * * *